US011674106B2

(12) United States Patent
Jones et al.

(10) Patent No.: US 11,674,106 B2
(45) **Date of Patent: *Jun. 13, 2023**

(54) LOW ZINC LUBRICANT COMPOSITION

(71) Applicant: The Lubrizol Corporation, Wickliffe, OH (US)

(72) Inventors: Joanne L. Jones, Nottingham (GB); Mark C. Davies, Pudong (CN); Michael R. Sutton, Matlock (GB); Patrick E. Mosier, Bay Village, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/631,645

(22) PCT Filed: Jul. 17, 2018

(86) PCT No.: PCT/US2018/042369

§ 371 (c)(1),
(2) Date: Jan. 16, 2020

(87) PCT Pub. No.: WO2019/018326

PCT Pub. Date: Jan. 24, 2019

(65) Prior Publication Data

US 2020/0208074 A1 Jul. 2, 2020

Related U.S. Application Data

(60) Provisional application No. 62/533,297, filed on Jul. 17, 2017.

(51) Int. Cl.

| | |
|---|---|
| ***C10M 169/04*** | (2006.01) |
| ***C10M 101/00*** | (2006.01) |
| ***C10M 125/24*** | (2006.01) |
| ***C10M 129/52*** | (2006.01) |
| ***C10M 133/04*** | (2006.01) |
| ***C10M 133/16*** | (2006.01) |
| *C10N 30/00* | (2006.01) |
| *C10N 40/25* | (2006.01) |
| *C10N 10/02* | (2006.01) |
| *C10N 10/04* | (2006.01) |
| *C10N 20/02* | (2006.01) |
| *C10N 20/04* | (2006.01) |
| *C10N 30/04* | (2006.01) |
| *C10N 30/06* | (2006.01) |

(Continued)

(52) U.S. Cl.

CPC ..... *C10M 169/045* (2013.01); *C10M 101/00* (2013.01); *C10M 125/24* (2013.01); *C10M 129/52* (2013.01); *C10M 133/04* (2013.01); *C10M 133/16* (2013.01); *C10M 2207/262* (2013.01); *C10M 2215/08* (2013.01); *C10M 2215/086* (2013.01); *C10M 2217/043* (2013.01); *C10M 2219/046* (2013.01); *C10M 2223/043* (2013.01); *C10M 2223/045* (2013.01); *C10M 2223/049* (2013.01); *C10M 2223/06* (2013.01); *C10N 2010/02* (2013.01); *C10N 2010/04* (2013.01); *C10N 2020/02* (2013.01); *C10N 2020/04* (2013.01); *C10N 2030/04* (2013.01); *C10N 2030/06* (2013.01); *C10N 2030/10* (2013.01); *C10N 2030/36* (2020.05); *C10N 2030/42* (2020.05); *C10N 2030/45* (2020.05); *C10N 2030/52* (2020.05); *C10N 2040/253* (2020.05); *C10N 2060/14* (2013.01)

(58) Field of Classification Search

CPC ..... C10M 169/045; C10M 125/24; C10M 129/52; C10M 133/04; C10M 133/16; C10M 101/00; C10M 2207/262; C10M 2215/08; C10M 2215/086; C10M 2217/043; C10M 2219/046; C10M 2223/045; C10M 2223/043; C10M 2223/049; C10M 2223/06; C10N 2040/25

USPC ..... 508/391

See application file for complete search history.

(56) References Cited

U.S. PATENT DOCUMENTS

| | | | |
|---|---|---|---|
| 3,197,405 | A | 7/1965 | Le Suer |
| 4,863,623 | A | 9/1989 | Nalesnik |

(Continued)

FOREIGN PATENT DOCUMENTS

| | | |
|---|---|---|
| CA | 1183125 | 2/1985 |
| GB | 2105743 | 3/1983 |

(Continued)

OTHER PUBLICATIONS

Dianjia Li et al., "Equipment Lubrication Technology", Ordnance Industry Press, Jan. 2006, 1st Edition, p. 203.

*Primary Examiner* — Vishal V Vasisth

(74) *Attorney, Agent, or Firm* — Eryn Fuhrer; Michael Miller

(57) ABSTRACT

The disclosed technology relates to lubricants for compression ignition internal combustion engines, particularly those demonstrating at least one of improved seals performance, reduced deposit formation, and excellent durability. The present invention provides a low zinc lubricating composition comprising (a) an oil of lubricating viscosity, (b) a borated dispersant, and (c) a metal-free organo-phosphorus anti-wear additive, wherein the lubricating composition is substantially free of a metal containing sulfur coupled alkyl phenol compound. Further, the low zinc lubricating composition contains zinc in an amount less than 600 ppm by weight of the composition.

10 Claims, No Drawings

(51) Int. Cl.
*C10N 30/10* (2006.01)
*C10N 60/14* (2006.01)

(56) References Cited

U.S. PATENT DOCUMENTS 5,078,893 A * 1/1992 Ryer ..... C10M 137/02 508/195
6,107,257 A 8/2000 Valcho et al.
6,107,258 A 8/2000 Esche, Jr. et al.
6,117,825 A 9/2000 Liu et al.
7,285,516 B2 10/2007 Carrick et al.
7,407,919 B2 8/2008 Wilk et al.
7,419,940 B2 9/2008 Yoon et al.
7,615,521 B2 11/2009 Eveland et al.
7,651,987 B2 1/2010 Kocsis et al.
7,696,136 B2 4/2010 Migdal et al.
7,767,633 B2 8/2010 Van Dam
7,807,611 B2 10/2010 Kocsis et al.
8,557,753 B2 10/2013 Gieselman et al.
8,637,437 B2 1/2014 Gieselman et al.
2003/0013619 A1* 1/2003 Sato ..... C10M 163/00 508/192
2005/0038319 A1 2/2005 Goldwasser et al.
2005/0043191 A1 2/2005 Farng et al.
2010/0197536 A1 8/2010 Mosier et al.
2014/0162920 A1* 6/2014 Saccomando ..... C10M 133/44 508/297
2017/0267941 A1* 9/2017 Zhang ..... C10M 165/00

FOREIGN PATENT DOCUMENTS

WO 2006015130 2/2006
WO 2006044411 4/2006
WO 2006047486 5/2006
WO 2008147704 12/2008
WO 2015106083 7/2015
WO 2015106090 7/2015
WO 2017/079575 A1 5/2017
WO 2017/083546 A1 5/2017
WO 2018/013451 A1 1/2018

* cited by examiner

LOW ZINC LUBRICANT COMPOSITION

CROSS REFERENCE TO RELATED APPLICATION

This application claims priority from PCT Application Serial No. PCT/US2018/042369 filed on Jul. 17, 2018, which claims the benefit of U.S. Provisional Application No. 62/533,297 filed on Jul. 17, 2017, both of which are incorporated in their entirety by reference herein.

BACKGROUND OF THE INVENTION

The disclosed technology relates to lubricants for compression ignition internal combustion engines, particularly those demonstrating at least one of improved seals performance, reduced deposit formation, and excellent durability.

Lubrication of internal combustion engines has been a practice for many decades, yet continual improvement in lubricant technology is ongoing as new engines and new standards have been developed. Formulations directed to spark ignition engines and compression ignition engines, for instance, must address limits placed on sulfated ash, phosphorus, and sulfur content ("SAPS"), and restrictions in these components often lead to upper limits on the amount of metal-containing additives that can be included in the lubricant. Reduction in metal containing additives is necessary to reduce the impact of metal ash on exhaust aftertreatment devices and to reduce the emission of particulate matter.

Chief among these metal-containing additives are zinc dialkyldithiophosphates (ZDDP) for wear and oxidation protection and overbased metal detergents for cleanliness and acid control. ZDDP has been the industry standard for reducing valve train wear, protecting against liner wear, and reducing oxidation leading to corrosive wear. However, the zinc contributes to an increase in sulfated ash in the lubricating oil and the phosphorus causes inactivation of oxidation catalysts used in exhaust after-treatment devices.

Alkylphenol based detergents are known for efficacy to provide deposit control, antioxidancy, and assisting in reducing wear. However, certain alkylphenols and products prepared from them have come under increased scrutiny due to their association as potential endocrine disruptive materials. In particular, alkylphenol detergents which are based on oligomers of C 12 alkyl phenols may contain residual monomeric C12 alkyl phenol species. Reduction in use of phenate detergents has created a need to formulate without them while maintaining deposit control, antioxidancy and wear performance.

U.S. Patent Publication 2007-0111905 discloses lubricant compositions for heavy duty diesel engines which are free of zinc dialkyldithiophosphates. These compositions contain metal-containing detergents, preferably calcium sulfonate and/or calcium phenate detergents.

U.S. Patent Publication 2005-0043191 discloses a substantially zinc and phosphorus free lubricating oil which contains an additive system containing metal detergents, at least one borated ashless dispersant, at least an amine anti-oxidant and a tri-nuclear molybdenum compound. The lubricant contains a minimum of 120 ppm boron and a minimum of 80 ppm molybdenum.

U.S. Patent Publication 2005-0137096 discloses an engine lubricant that is substantially free of zinc and phosphorus contains an anti-wear additive comprising borated 1,2-epoxy mixed polybutenes having an average carbon number in the range of C20 to C120.

International publications WO 2015/106083A1 and WO 2015/106090 disclose diesel lubricant compositions that are substantially free of phenate and other alkylphenol based detergents.

The disclosed technology provides a low zinc lubricant composition suitable for reducing deposit formation in compression ignition internal combustion engines, while maintaining durability. The disclosed technology further provides a lubricant composition free of or substantially free of a detergent derived from an alkylphenol compound.

SUMMARY OF THE INVENTION

The present invention provides a low zinc lubricating composition comprising (a) an oil of lubricating viscosity, (b) a borated dispersant, and (c) a metal-free organo-phosphorus anti-wear additive, wherein the lubricating composition is substantially free of a metal containing sulfur coupled alkyl phenol compound, and wherein the lubricating composition contains zinc in an amount less than 600 ppm by weight of the composition.

The present invention provides a low zinc lubricating composition comprising (a) an oil of lubricating viscosity, (b) a borated dispersant, (c) a metal-free organo-phosphorus anti-wear additive, and (d) a phosphorus-free anti-wear additive, wherein the lubricating composition is substantially free of a metal containing sulfur coupled alkylphenol compound, and wherein the lubricating composition contains zinc in an amount less than 600 ppm by weight of the composition.

The invention further provides a method of lubricating a light duty compression-ignition internal combustion engine with a low zinc lubricating composition comprising (a) an oil of lubricating viscosity, (b) a borated dispersant, and (c) a metal-free organo-phosphorus anti-wear additive, wherein the lubricating composition is substantially free of a metal containing sulfur coupled alkylphenol compound, and wherein the lubricating composition contains zinc in an amount less than 600 ppm by weight of the composition.

The invention further provides a method of reducing deposit formation in a light-duty compression ignition internal combustion engine by operating the engine with a lubricant composition comprising (a) an oil of lubricating viscosity, (b) a borated dispersant, and (c) a metal-free organo-phosphorus anti-wear additive, wherein the lubricating composition is substantially free of a metal containing sulfur coupled alkylphenol compound, and wherein the lubricating composition contains zinc in an amount less than 600 ppm by weight of the composition.

The invention further provides a method of improving the retention of base number, i.e. total base number (TBN), further into an engine oil drain interval. TBN retention may be an important part of mitigating the effects of acid build-up in an engine oil lubricant composition.

DETAILED DESCRIPTION

Various preferred features and embodiments will be described below by way of non-limiting illustration.

The disclosed technology provides a low zinc lubricating composition, a method for lubricating an internal combustion engine with a low zinc lubricating composition, and the use as disclosed above.

Oil of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment, oils may be prepared by a Fischer-Tropsch gas-to-liquid synthetic procedure as well as other gas-to-liquid oils.

Oils of lubricating viscosity may also be defined as specified in the April 2008 version of "Appendix E-API Base Oil Interchangeability Guidelines for Passenger Car Motor Oils and Diesel Engine Oils", section 1.3 Subheading 1.3. "Base Stock Categories". The API Guidelines are also summarized in U.S. Pat. No. 7,285,516 (see column 11, line 64 to column 12, line 10). In one embodiment, the oil of lubricating viscosity may be an API Group II, Group III, or Group IV oil, or mixtures thereof. The five base oil groups are as follows:

| Base Oil Category | Sulfur (%) | Saturates (%) | Viscosity Index |
|---|---|---|---|
| Group I | >0.03 and/or | <90 | 80 to 120 |
| Group II | ≤0.03 and | ≥90 | 80 to 120 |
| Group III | ≤0.03 and | ≥90 | ≥120 |
| Group IV | All polyalphaolefins (PAO) | | |
| Group V | All others not included in Groups I, II, III, or IV | | |

The amount of the oil of lubricating viscosity present is typically the balance remaining after subtracting from 100 weight % (wt %) the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

In one embodiment, the base oil has a kinematic viscosity at 100° C. from 2 $mm^2/s$ (centi Stokes—cSt) to 16 $mm^2/s$, from 3 $mm^2/s$ to 10 $mm^2/s$, or even from 4 $mm^2/s$ to 8 $mm^2/s$.

In one embodiment, the base oil comprises at least 30 wt % of Group II or Group III base oil. In another embodiment, the base oil comprises at least 60 weight % of Group II or Group III base oil, or at least 80 wt % of Group II or Group III base oil. In one embodiment, the lubricant composition comprises less than 20 wt % of Group IV (i.e. polyalphaolefin) base oil. In another embodiment, the base oil comprises less than 10 wt % of Group IV base oil. In one embodiment, the lubricating composition is substantially free of (i.e. contains less than 0.5 wt %) of Group IV base oil.

Ester base fluids, which are characterized as Group V oils, have high levels of solvency as a result of their polar nature. Addition of low levels (typically less than 10 wt %) of ester to a lubricating composition may significantly increase the resulting solvency of the base oil mixture. Esters may be broadly grouped into two categories: synthetic and natural. An ester base fluid would have a kinematic viscosity at 100° C. suitable for use in an engine oil lubricant, such as between 2 cSt and 30 cSt, or from 3 cSt to 20 cSt, or even from 4 cSt to 12 cSt.

Synthetic esters may comprise esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, and alkenyl malonic acids) with any of variety of monohydric alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. Other synthetic esters include those made from C5 to C12 monocarboxylic acids and polyols and polyol ethers such as neopentyl glycol, trimethylolpropane, pentaerythritol, dipentaerythritol, and tripentaerythritol. Esters can also be monoesters of monocarboxylic acids and monohydric alcohols.

Natural (or bio-derived) esters refer to materials derived from a renewable biological resource, organism, or entity, distinct from materials derived from petroleum or equivalent raw materials. Natural esters include fatty acid triglycerides, hydrolyzed or partially hydrolyzed triglycerides, or transesterified triglyceride esters, such as fatty acid methyl ester (or FAME). Suitable triglycerides include, but are not limited to, palm oil, soybean oil, sunflower oil, rapeseed oil, olive oil, linseed oil, and related materials. Other sources of triglycerides include, but are not limited to, algae, animal tallow, and zooplankton. Methods for producing biolubricants from natural triglycerides is described in, e.g., United States patent application 2011/0009300A1.

In one embodiment, the lubricating composition comprises at least 2 wt % of an ester base fluid. In one embodiment the lubricating composition of the invention comprises at least 4 wt % of an ester base fluid, or at least 7 wt % of an ester base fluid, or even at least 10 wt % of an ester base fluid.

Borated Dispersant

The lubricating compositions of the present invention comprise a borated dispersant. The borated dispersant may be a succinimide dispersant, a Mannich dispersant, a polyolefin succinic acid ester, amide, or ester-amide, or mixtures thereof, borated using one or more of a variety of agents selected from the group consisting of the various forms of boric acid (including metaboric acid, $HBO_2$, orthoboric acid, $H_3BO_3$, and tetraboric acid, $H_2B_4O_7$), boric oxide, boron trioxide, and alkyl borates. In one embodiment the borating agent is boric acid which may be used alone or in combination with other borating agents. Methods of preparing borated dispersants are known in the art. The borated dispersant may be prepared in such a way that they contain 0.1 wt % to 2.5 wt % boron, or 0.1 wt % to 2.0 wt % boron or 0.2 to 1.5 wt % boron or 0.3 to 1.0 wt % boron.

In one embodiment, the borated dispersant may be a borated succinimide dispersant The succinimide dispersant may be a derivative of an aliphatic polyamine, or mixtures thereof. The aliphatic polyamine may be aliphatic polyamine such as an ethylenepolyamine, a propylenepolyamine, a butylenepolyamine, or mixtures thereof. In one embodiment, the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in United States Patent Publications 2011/0306528 and 2010/0298185), a nitroaniline, an aminocarbazole, an amino-indazolinone, an aminopyrimidine, 4-(4-nitrophenylazo)aniline, or combinations thereof. In one embodiment, the dispersant is derivative of an aromatic amine wherein the aromatic amine has at least three non-continuous aromatic rings.

The succinimide dispersant may be a derivative of a polyether amine or polyether polyamine. Typical polyether amine compounds contain at least one ether unit and will be chain terminated with at least one amine moiety. The polyether polyamines can be based on polymers derived from $C_2$-$C_6$ epoxides such as ethylene oxide, propylene oxide, and butylene oxide. Examples of polyether polyamines are sold under the Jeffamine® brand and are commercially available from Hunstman Corporation located in Houston, Tex.

The borated dispersant may be based upon a borated polyisobutylene succinimide dispersant, wherein the polyisobutylene of the borated polyisobutylene succinimide has a number average molecular weight of 350 to 5000, or 550 to 3000 or 750 to 2500 or 350 to 2200, or 350 to 1350, or 350 to 1150 or 350 to 750 or 550 to 2200 or 550 to 1350 or 750 to 2200.

Suitable polyisobutylenes for use in the borated polyisobutylene succinimide dispersant, may include those formed from polyisobutylene or highly reactive polyisobutylene having at least about 50 mol %, such as about 60 mol %, and particularly from about 70 mol % to about 90 mol % or greater than 90 mol %, terminal vinylidene content. Suitable polyisobutenes may include those prepared using $BF_3$ catalysts. In one embodiment, the borated dispersant is derived from a polyolefin having number average molecular weight of 350 to 3000 Daltons and a vinylidene content of at least 50 mol %, or at least 70 mol %, or at least 90 mol %.

The dispersant may be prepared/obtained/obtainable from reaction of succinic anhydride by an "ene" or "thermal" reaction, by what is referred to as a "direct alkylation process." The "ene" reaction mechanism and general reaction conditions are summarised in "Maleic Anhydride", pages, 147-149, Edited by B. C. Trivedi and B. C. Culbertson and Published by Plenum Press in 1982. The dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The dispersant may also be obtained/obtainable from a chlorine-assisted process, often involving Diels-Alder chemistry, leading to formation of carbocyclic linkages. The process is known to a person skilled in the art. The chlorine-assisted process may produce a dispersant that is a polyisobutylene succinimide having a carbocyclic ring present on 50 mole % or more, or 60 to 100 mole % of the dispersant molecules. Both the thermal and chlorine-assisted processes are described in greater detail in U.S. Pat. No. 7,615,521, columns 4-5 and preparative examples A and B.

In one embodiment, the borated dispersant may be a borated polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically diethyleneamine).

The borated dispersant may be used alone or as part of a mixture of borated dispersants. If a mixture of borated dispersants is used, there may be two to five, or two to three or two borated dispersants.

The boron-containing dispersant may be present in an amount to deliver at least 25 ppm boron, at least 50 ppm boron, or at least 100 ppm boron to the lubricant composition.

The borated dispersant is typically present at 0.1 wt % to 10 wt %, or 0.5 wt % to 7 wt %, or 0.8 wt % to 4.5 wt %, or 1.0 wt % to 4.5 wt % or 2.0 wt % to 4.0 wt % or 1.5 wt % to 3 wt % of the lubricating oil composition.

The lubricating composition may further comprise a non-borated ashless dispersant. The non-borated dispersant may comprise any non-borated version of the borated dispersants described above. In one embodiment, the non-borated dispersant may comprise a polyisobutylene succinimide dispersant, wherein the polyisobutylene has a number average molecular weight of 350 to 5000, or 550 to 3000 or 750 to 2500 or 350 to 2200, or 350 to 1350, or 350 to 1150 or 350 to 750 or 550 to 2200 or 550 to 1350 or 750 to 2200.

In another embodiment, the non-borated ashless dispersant may comprise a polyalphaolefins (PAO) containing dispersant selected from the group consisting of a polyalphaolefin succinimide, a polyalphaolefin succinamide, a polyalphaolefin acid ester, a polyalphaolefin oxazoline, a polyalphaolefin imidazoline, a polyalphaolefin succinamide imidazoline, and combinations thereof.

Polyalphaolefins (PAO) useful as feedstock in forming the PAO conataining dispersants are those derived from oligomerization or polymerization of ethylene, propylene, and α-olefins. Suitable α-olefins include 1-butene, 1-pentene, 1-hexene, 1-heptene, 1-octene, 1-nonene, 1-decene, 1-undecene, 1-dodecene, 1-tetradecene, and 1-octadecene. Feedstocks containing a mixture of two or more of the foregoing monomers as well as other hydrocarbons are typically employed when manufacturing PAOs commercially. The PAO may take the form of dimers, trimers, tetramers, polymers, and the like.

The PAO may be reacted with maleic anhydride (MA) to form the polyalphaolefin succinic anhydride (PAO-SA) and subsequently the anhydride may reacted with one or more of polyamines, aminoalcohols, and alcohols/polyols to form polyalphaolefin succinimide, polyalphaolefin succinamide, polyalphaolefin succinic acid ester, polyalphaolefin oxazoline, polyalphaolefin imidazoline, polyalphaolefin-succinamide-imidazoline, and mixtures thereof.

The non-borated, ashless dispersant may be present at 0.1 wt % to 10 wt %, or 0.5 wt % to 7 wt %, or 1 wt % to 5 wt %, or 1.5 wt % to 4 wt % of the lubricating oil composition.

Either or both of the borated and non-borated dispersant may have a carbonyl to nitrogen ratio (CO:N ratio) of 5:1 to 1:10, 2:1 to 1:10, or 2:1 to 1:5, or 2:1 to 1:2. In one embodiment the dispersant may have a CO:N ratio of 2:1 to 1:10, or 2:1 to 1:5, or 2:1 to 1:2, or 1:1.4 to 1:0.6, or 0.9:1 to 1.6:1, or 0.95:1 to 1.5:1, or 1:1 to 1:4.

Organo-Phosphorus Anti-Wear Additive

The organo-phosphorus anti-wear agent may be a metal free organo-phosphorus anti-wear agent. The organo-phosphorus agent may contain sulfur or may be sulfur-free. Sulfur-free phosphorus-containing antiwear agents may be phosphites, phosphonates, alkylphosphate esters, amine or ammonium phosphate salts, or mixtures thereof.

Phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Amine phosphates may be amine salts of (i) monohydrocarbylphosphoric acid, (ii) dihydrocarbylphosphoric acid, (iii) hydroxy-substituted di-ester of phosphoric acid, or (iv) phosphorylated hydroxy-substituted di- or tri-ester of phosphoric acid. The amine salt of a sulfur-free phosphorus-containing compound may be salts of primary amines, secondary amines, tertiary amines, or mixtures thereof.

Amine phosphate salts may be derived from mono- or di-hydrocarbyl phosphoric acid (typically alkyl phosphoric acid), or mixtures thereof. The alkyl of the mono- or di-hydrocarbyl phosphoric acid may comprise linear or branched alkyl groups of 3 to 36 carbon atoms. The hydrocarbyl group of the linear or branched hydrocarbylphosphoric acid may contain 4 to 30, or 8 to 20 carbon atoms. Examples of a suitable hydrocarbyl group of the hydrocarbyl phosphoric acid may include isopropyl, n-butyl, sec-butyl, amyl, 4-methyl-2-pentyl (i.e., methylamyl), n-hexyl, n-heptyl, n-octyl, iso-octyl, 2-ethylhexyl, nonyl, 2-propylheptyl, decyl, dodecyl, tetradecyl, hexadecyl, octadecyl, oleyl, or combinations thereof. In one embodiment, the phosphate is a mixture of mono- and di-(2-ethyl)hexylphosphate.

Examples of suitable primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen™" amines (products available from Akzo Chemicals, Chicago, Ill.), such as Armeen C, Armeen O, Armeen O L, Armeen T, Armeen H T, Armeen S and Armeen S D, wherein the letter designation relates to the fatty group, such as coco, oleyl, tallow, or stearyl groups.

In one embodiment, the metal-free phosphorus anti-wear agent may be present in the lubricant composition in amount of 0.01 to 5 wt %, or 0.1 to 3.2 wt %, or 0.35 to 1.8 wt %, or 0.5 to 1.5 wt %, or 0.5 to 0.9 wt %. In one embodiment, the metal-free phosphorus anti-wear agent may be present in an amount to provide 0.01 wt % to 0.15 wt % phosphorus, or 0.01 to 0.08 wt % phosphorus, or 0.025 to 0.065 wt % phosphorus to the composition.

Overbased Detergent

In one embodiment, the invention provides a lubricating composition further comprising an alkali or alkaline earth metal sulfonate detergent. The metal-containing sulfonate detergent may be an overbased detergent. Overbased detergents, otherwise referred to as overbased or superbased salts, are characterized by a metal content in excess of that which would be necessary for neutralization according to the stoichiometry of the metal and the particular acidic organic compound reacted with the metal.

The overbased metal-containing sulfonate detergent may include calcium salts, magnesium salts, sodium salts, or mixtures thereof of one or more sulfonates. Other useful metals may include titanium and zirconium. Overbased sulfonates typically have a total base number of 250 to 600, or 300 to 500. Overbased detergents are known in the art. In one embodiment, the sulfonate detergent may be predominantly a linear alkylbenzene sulfonate detergent having a metal ratio of at least 8 as is described in paragraphs [0026] to [0037] of US Patent Publication 2005065045 (and granted as U.S. Pat. No. 7,407,919). The linear alkylbenzene sulfonate detergent may be particularly useful for assisting in improving fuel economy. The linear alkyl group may be attached to the benzene ring anywhere along the linear chain of the alkyl group, but often in the 2, 3 or 4 position of the linear chain, and in some instances, predominantly in the 2 position, resulting in the linear alkylbenzene sulfonate detergent. Overbased sulfonate detergents are known in the art.

In one embodiment, the overbased calcium sulfonate detergent may be present in an amount to deliver at least 500 ppm calcium by weight and no more than 3000 ppm calcium by weight, or at least 1000 ppm calcium by weight, or at least 2000 ppm calcium by weight, or no more than 2500 ppm calcium by weight to the lubricating composition. In one embodiment, the overbased magnesium sulfonate detergent may be present in an amount to deliver no more than 500 ppm by weight of magnesium to the lubricating composition, or no more than 330 ppm by weight, or no more than 125 ppm by weight, or no more than 45 ppm by weight. In one embodiment, the overbased a magnesium sulfonate detergent may be present in an amount to deliver at least 200 ppm by weight of magnesium, or at least 450 ppm by weight magnesium, or at least 700 ppm by weight magnesium to the lubricating composition. In one embodiment, both calcium and magnesium containing sulfonate detergents may be present in the lubricating composition. Calcium and magnesium sulfonate detergents may be present such that the weight ratio of calcium to magnesium is 10:1 to 1:10, or 8:3 to 4:5, or 1:1 to 1:3.

In one embodiment, the detergent may comprise a mixture of calcium and magnesium containing detergents. The detergent may provide, in one embodiment, 800 to 1300 ppm calcium and 450 to 800 ppm magnesium and in another embodiment 900 to 1200 ppm calcium and 500 to 750 ppm magnesium.

The overbased sulfonate detergent may be present at 0.1 wt % to 15 wt %, or 0.1 wt % to 10 wt %, or 0.2 wt % to 8 wt %, or 0.2 wt % to 3 wt %.

In one embodiment, the lubricating composition may further comprise an alkali or alkaline earth metal salicylate detergent or salixarate detergent or mixture thereof. The metal containing salicylate or salixarate detergent may be an overbased detergent. Useful salicylate and salixarate detergents may include calcium salts, magnesium salts, sodium salts or mixtures thereof. Other useful metals may include titanium and zirconium. The overbased metal salicylate detergent may be present at 0.1 wt % to 15 wt %, or 0.1 wt % to 10 wt %, or 0.2 wt % to 8 wt %, or 0.2 wt % to 3 wt %. The overbased metal salixarate detergent may be present at 0.1 wt % to 15 wt %, or 0.1 wt % to 10 wt %, or 0.2 wt % to 8 wt %, or 0.2 wt % to 3 wt %. In one embodiments, the lubricating composition may free or substantially free of a metal containing salicylate detergent or metal containing salixarate detergent or both. In one embodiment, the lubricating composition comprises less than 0.2 wt. % or 0.1 wt. % or 0.05 wt. % or 0.01 wt. % of a metal containing salicylate detergent, metal containing salixarate detergent or both.

In one embodiment, the lubricating composition is free or substantially free of a metal containing sulfur coupled alkyl phenol compound. Such compounds may be exemplified by alkali and alkaline earth metal containing phenate detergents, such as magnesium phenate detergents, calcium phenate detergents and sodium phenate detergents and further including overbased metal containing phenate detergents, all of which are known in the art. In one embodiment, the lubricating composition comprises less than 0.2 wt. % or 0.1 wt. % or 0.05 wt. % or 0.01 wt. % or 0.005 wt % of a metal containing sulfur coupled alkyl phenol compound.

In one embodiment, the lubricating composition is free or substantially free of a metal containing saligenin detergent, such as magnesium saligenin detergent, calcium saligenin detergents and sodium saligenin detergents and further including overbased metal containing saligenin detergents, all of which are known in the art. In one embodiment, the lubricating composition comprises less than 0.2 wt. % or 0.1 wt. % or 0.05 wt. % or 0.01 wt. % or 0.005 wt % of a metal containing saligenin detergent.

According to some embodiments, the total amount of soap contributed by the detergent may be from about 0.08 or 1.0 to less than 0.9 or 0.7 or 0.5 or 0.4 or 0.3 or 0.25 wt. % with respect to the lubricating composition. The lubricating composition may be free or substantially free of phenate soap. The soap may substantially consist of sulfonate soap. As used herein the term "soap" means the surfactant portion of a detergent and does not include a metal base, such as calcium carbonate. The soap term may also be referred to as a detergent substrate. For example, the sulfonate detergents described herein, the soap or substrate may be a neutral salt of an alkylbenzenesulfonic acid.

Metal-containing detergents also contribute sulfated ash to a lubricating composition. Sulfated ash may be determined by ASTM D874. In one embodiment, the lubricating composition of the invention comprises a metal-containing detergent in an amount to deliver at least 0.4 wt. % sulfated ash to the total composition. In another embodiment, the metal-containing detergent is present in an amount to deliver at least 0.6 wt. % sulfated ash, or at least 0.75 wt. % sulfated ash, or even at least 0.9 wt. % sulfated ash to the lubricating composition.

Phosphorus Free Anti-Wear Agent

In one embodiment, the invention provides a lubricating composition which further includes an ashless antiwear agent different from the organo-phosphorus antiwear agent described above. Examples of suitable antiwear agents include hydroxy-carboxylic acid derivatives such as esters, amides, imides or amine or ammonium salt, sulfurized olefins, thiocarbamate-containing compounds, such as thiocarbamate esters, thiocarbamate amides, thiocarbamic ethers, alkylene-coupled thiocarbamates, and bis(S-alkyldithiocarbamyl) disulphides.

In one embodiment, the ashless antiwear agent may include a compound derived from a hydroxycarboxylic acid. In one embodiment the ashless antiwear agent is derived from at least one of hydroxy-polycarboxylic acid di-ester, a hydroxy-polycarboxylic acid di-amide, a hydroxy-polycarboxylic acid imide, and a hydroxy-polycarboxylic acid ester amide. In one embodiment the ashless antiwear agent is derived from a hydroxy-polycarboxylic acid imide.

Examples of a suitable a hydroxycarboxylic acid include citric acid, tartaric acid, lactic acid, glycolic acid, hydroxypropionic acid, hydroxyglutaric acid, or mixtures thereof. In one embodiment ashless antiwear agent is derived from tartaric acid, citric acid, hydroxy-succinic acid, dihydroxy mono-acids, mono-hydroxy diacids, or mixtures thereof. In one embodiment the ashless antiwear agent includes a compound derived from tartaric acid or citric acid. In one embodiment the ashless antiwear agent includes a compound derived from tartaric acid.

US Patent Application 2005/198894 discloses suitable hydroxycarboxylic acid compounds, and methods of preparing the same.

Canadian Patent 1 183 125; US Patent Publication numbers 2006/0183647 and US-2006-0079413: U.S. Patent Application No. 60/867,402; and British Patent 2 105743 A. all disclose examples of suitable tartaric acid derivatives. The antiwear agent may in one embodiment include a tartrate or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate.

The ashless phosphorus-free antiwear agent may be present at 0.1 to 5 wt %, 0.1 wt % to 3 wt %, or 0.2 to 3 or 0.1 wt % to 1.5 wt %, or 0.5 wt % to 1.1 wt % of the lubricating composition.

Oxyalkylated Hydrocarbyl Phenol

In some embodiments, the lubricating composition may comprise an oxyalkylated hydrocarbyl phenol, may be represented by Formula 1:

FORMULA 1

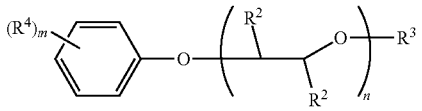

wherein each $R^2$ is independently hydrogen or a hydrocarbyl group of 1 to 6 carbon atoms;

$R^3$ is hydrogen, a hydrocarbyl group of 1 to 24 carbon atoms, or an acyl group represented by —C(=O)$R^5$, $R^5$ is a hydrocarbyl group of 1 to 24 carbon atoms;

each $R^4$ is independently a hydrocarbyl group of 1 to 220, or 20 to 220, wherein at least one $R^4$ contains 25 to 200, or 35 to 180 or 40 to 180 to 60 to 180 or 40 to 96 carbon atoms;

n=1 to 10; and m=1 to 3.

The oxyalkylated hydrocarbyl phenol may be represented by Formula 1:

wherein one $R^2$ is methyl, and the second $R^2$ is hydrogen;

$R^3$ is hydrogen, a hydrocarbyl group of 1 to 24 carbon atoms, or an acyl group represented by —C(=O)$R^5$, $R^5$ is a hydrocarbyl group of 1 to 24 carbon atoms;

each $R^4$ is a hydrocarbyl group of 25 to 200, or 35 to 180 or 40 to 180 to 60 to 180 or 40 to 96 carbon atoms;

n=1 to 10; and m=1.

The oxyalkylated hydrocarbyl phenol may be represented by Formula 1:

wherein one $R^2$ is methyl, and the second $R^2$ is hydrogen;

$R^3$ is hydrogen, a hydrocarbyl group of 1 to 24 carbon atoms, or an acyl group represented by —C(=O)$R^5$, $R^5$ is a hydrocarbyl group of 1 to 24 carbon atoms;

$R^4$ is a hydrocarbyl group of 1 to 220 or 20 to 220 carbon atoms, wherein at least one $R^4$ comprises a polyalk(en)yl group containing 25 to 200, or 35 to 180 or 40 to 180 to 60 to 180 or 40 to 96 carbon atoms;

n=2 to 8; and m=1.

The oxyalkylated hydrocarbyl phenol may be represented by Formula 1:

wherein one $R^2$ is methyl, and the second $R^2$ is hydrogen;

$R^3$ is hydrogen, a hydrocarbl group of 1 to 24 carbon atoms, or an acyl group represented by —C(C=O)$R^5$, $R^5$ is a hydrocarbyl group of 1 to 24 carbon atoms;

each a hydrocarbyl group of 1 to 220 or 20 to 220 carbon atoms comprises a polyisobutenyl group containing 25 to 200, or 35 to 180 or 40 to 180 to 60 to 180 or 40 to 96 carbon atoms;

n=2 to 8 (or 3 to 5); and m=1.

The $R^4$ group of each of the formulae above may be located in the para-position relative to the oxyalkylated group, and the resultant formula is represented by structure:

FORMULA 1(a)

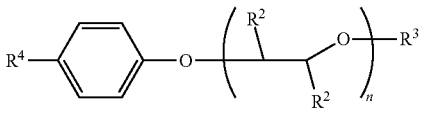

wherein variables $R^2$ to $R^5$, n, and m are defined previously.

In one embodiment, the oxyalkylated hydrocarbyl phenol of the present invention is represented by Formula 1(a): wherein $R^4$ is a polyolefinic group such as a polypropenyl or a polyisobutenyl group (typically a polyisobutenyl group), and variables $R^2$, $R^3$, $R^5$, and n are defined previously. The polyisobutenyl group may have a number average molecular weight of 350 to 2500, or 550 to 2300, or 750 to 1150. In one embodiment, the polyisobutenyl group has a number average molecular weight of 950-1000. The polypropenyl group may have a number average molecular weight of 740 to 1200, or 800-850. In one embodiment the polypropenyl group has a number average molecular weight of 825.

In one embodiment, the oxyalkylated hydrocarbyl phenol of the present invention is represented by Formula 1(b):

FORMULA 1(b)

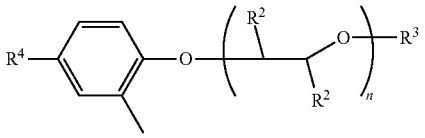

wherein $R^4$ is a polyolefinic group such as a polypropenyl or a polyisobutenyl group (typically a polyisobutenyl group), and variables $R^2$, $R^3$, $R^5$, and n, are defined previously. The polyisobutenyl group may have a number average molecular weight of 350 to 2500, or 550 to 2300, or 750 to 1150. In one embodiment the polyisobutenyl group has a number average molecular weight of 950-1000.

The oxyalkylated group of the oxyalkylated hydrocarbyl phenol may have the formula —$(R^1O)_n$—, wherein $R^1$ is an ethylene, propylene, butylene group, or mixtures thereof; and n may independently be from 1 to 50, or 1 to 20, or 1 to 10, or 2 to 5.

The oxyalkylated group of the oxyalkylated hydrocarbyl phenol may be either a homopolymer or copolymer or oligomers thereof. If the oxyalkylated group is in the form of a copolymer, or oligomer thereof, the oxyalkylated group may have either random or block architecture.

In one embodiment the oxyalkylated group (or $R^1$ is a propylene, or butylene group i.e., the oxyalkylated group does not require an ethylene group. If an ethylene group is present the oxyalkylate group may be a copolymer, or oligomer thereof with either propylene or butylene oxide i.e., blocks of (i) —$CH_2$ $CH_2O$— with (ii) —$CH_2CH_2CH_2CH_2O$— or —$CH_2CH(CH_3)CH_2O$— or —$CH_2CH(CH_3)O$—.

In one embodiment the oxyalkylated group may be based upon propylene oxide.

The oxyalkylated hydrocarbyl phenol may be prepared by reacting a hydrocarbyl substituted phenol with an alkylene oxide (typically ethylene oxide, propylene oxide or butylene oxide), optionally in the presence of a base catalyst. Typically, the reaction occurs in the presence of a base catalyst.

The base catalyst may include sodium chloroacetate, sodium hydride or potassium hydroxide The aliphatic hydrocarbyl group (also represented by $R^4$) may be linear or branched, typically with at least one branching point. The aliphatic hydrocarbyl group typically has one, although it may in some embodiments be desirable to have to $R^4$ groups, with the second group being methyl. If a second $R^4$ group is present and is methyl, then the oxyalkylated hydrocarbyl phenol is a cresol.

In different embodiments the oxyalkylated hydrocarbyl phenol of the present invention may be present in an amount ranging from 0.01 wt % to 5 wt %, or 0.05 to 3.5 wt %, or 0.1 to 2.5 wt % of the lubricating composition. Typically, the oxyalkylated hydrocarbyl phenol is present in an amount from 0.25 to 2 wt % of the lubricating composition.

Other Performance Additives

The compositions of the invention may optionally comprise one or more additional performance additives. These additional performance additives may include one or more metal dialkyldithiophosphates, metal deactivators, viscosity modifiers, detergents, friction modifiers, antiwear agents, corrosion inhibitors, dispersants different from the borated dispersant of the invention, dispersant viscosity modifiers, extreme pressure agents, antioxidants, foam inhibitors, demulsifiers, pour point depressants, seal swelling agents, and any combination or mixture thereof. Typically, fully-formulated lubricating oil will contain one or more of these performance additives, and often a package of multiple performance additives.

In one embodiment, the invention provides a lubricating composition which further includes a metal dialkyldithiophosphate. Typically, the metal dialkyldithiophosphate may be a zinc dialkyldithiophosphate (ZDDP), or mixtures thereof. Zinc dialkyldithiophosphates are known in the art. The zinc dialkyldithiophosphate may be present at 0 wt % to 3 wt %, or 0.1 wt % to 1.5 wt %, or 0.5 wt % to 0.9 wt % of the lubricating composition, such that the total zinc contributed to the lubricant composition does not exceed 0.06 weight percent of the composition and in another embodiment 0.05 wt % or 0.03 wt %.

The zinc dialkyldithiophosphate may be derived from primary alcohols, secondary alcohols, or combinations thereof. Typically, they are derived from primary and secondary alcohols containing 3 to 12 carbon atoms and combinations thereof. In one embodiment the zinc alkyldithiophosphate comprises at least 25 mol % secondary alkyl groups, or at least 40 mol % secondary alkyl groups, or at least 75 mol % secondary alkyl groups, or at least 90 mol % secondary alkyl groups.

In one embodiment, the invention provides a lubricating composition further comprising a dispersant viscosity modifier, a friction modifier, a viscosity modifier, an antioxidant or a combination thereof, where each of the additives listed may be a mixture of two or more of that type of additive. In one embodiment, the invention provides a lubricating composition further comprising a boron-free polyisobutylene succinimide dispersant, an ashless antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulfonates and phenates), or a combination thereof, where each of the additives listed may be a mixture of two or more of that type of additive.

In one embodiment, the lubricating composition of the invention further comprises a dispersant viscosity modifier. The dispersant viscosity modifier may be present at 0.05 wt % to 5 wt %, or 0.05 wt % to 4 wt %, or 0.05 wt % to 2 wt % of the lubricating composition.

Suitable dispersant viscosity modifiers include functionalized polyolefins, for example, ethylene-propylene copolymers that have been functionalized with an acylating agent such as maleic anhydride and an amine; polymethacrylates functionalized with an amine, or esterified styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment, the dispersant viscosity modifier may include those described in U.S. Pat. No. 4,863,623 (see column 2, line 15 to column 3, line 52) or in International Publication WO2006/015130 (see page 2, paragraph [0008] and preparative examples are described at paragraphs [0065] to [0073]).

Antioxidants provide and/or improve the anti-oxidation performance of organic compositions, including lubricant compositions that contain organic components, by preventing or retarding oxidative and thermal decomposition. Suitable antioxidants may be catalytic or stoichiometric in activity and include any compound capable of inhibiting or decomposing free radicals, including peroxide.

Ashless antioxidants of the invention may comprise one or more of arylamines, diarylamines, alkylated arylamines, alkylated diaryl amines, phenols, hindered phenols, sulfurized olefins, or mixtures thereof. In one embodiment the lubricating composition includes an antioxidant, or mixtures thereof. The antioxidant may be present at 0.05 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment, the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or didecyl phenylnapthylamines.

Diarylamines of the invention may also be represented by Formula 2:

FORMULA 2

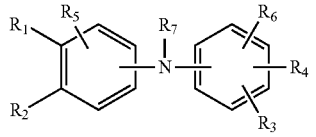

wherein $R_1$ and $R_2$ are moieties which, together with the carbon atoms to which they are bonded, are joined together to form a 5-, 6-, or 7-membered ring (such as a carbocyclic ring or cyclic hydrocarbylene ring); $R_3$ and $R_4$ are independently hydrogen, hydrocarbyl groups, or are moieties which, taken together with the carbon atoms to which they are bonded, form a 5-, 6-, or 7-membered ring (such as a carbocyclic ring or cyclic hydrocarbylene ring); $R_5$ and $R_6$ are independently hydrogen, hydrocarbyl groups, or are moieties (typically hydrocarbyl moieties) which, taken together with the carbon atoms to which they are attached, form a ring, or represent a zero-carbon or direct linkage between the rings; and $R_7$ is hydrogen or a hydrocarbyl group.

In one embodiment, the diarylamine is a N-phenyl-naphthylamine (PNA).

In another embodiment, the diarylamine may be represented by Formula (2a):

FORMULA (2a)

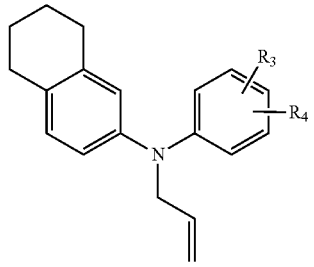

wherein $R_3$ and $R_4$ are defined as above.

In another embodiment, the diarylamine compounds include those having the general Formula (2b):

FORMULA (2b)

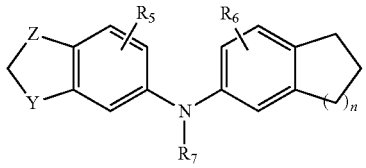

wherein $R_7$ is defined as above; $R_5$ and $R_6$ are independently hydrogen, hydrocarbyl groups or taken together may form a ring, such as a dihydroacridan; n=1 or 2; and Y and Z independently represent carbon or heteroatoms such as N, O and S.

In a particular embodiment, compounds of Formula (2) further comprise an N-allyl group, for example the compound of Formula (2c):

FORMULA (2c)

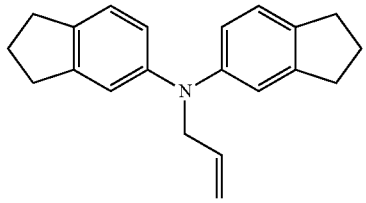

In one embodiment, the diarylamine is a dihydroacridan derivative of Formula (2d):

FORMULA (2d)

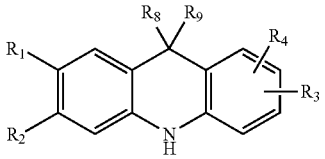

wherein $R_1$, $R_2$, $R_3$, and $R_4$ are defined above; $R_8$ and $R_9$ are independently hydrogen or a hydrocarbyl group of 1 to 20 carbon atoms.

In one embodiment, the diarylamine of Formula (2) is chosen such that $R_5$ and $R_6$ represent a direct (or zero-carbon) link between the aryl rings. The result is a carbazole of Formula (2g):

FORMULA (2g)

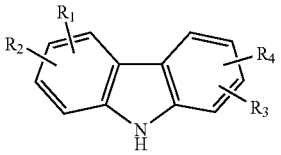

wherein $R_1$, $R_2$, $R_3$, and $R_4$ are defined as above.

The diarylamine antioxidant of the invention may be present on a weight basis of the lubrication composition at 0.1% to 10%, 0.35% to 5%, or even 0.5% to 2%.

The phenolic antioxidant may be a simple alkyl phenol, a hindered phenol, or coupled phenolic compounds.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, 4-dodecyl-2,6-di-tert-butylphenol, or butyl 3-(3,5-ditert-butyl-4-hydroxyphenyl)propanoate. In one embodiment, the hindered phenol antioxidant may be an ester and may include, e.g., Irganox™ L-135 from Ciba.

Coupled phenols often contain two alkylphenols coupled with alkylene groups to form bisphenol compounds. Examples of suitable coupled phenol compounds include 4,4'-methylene bis-(2,6-di-tert-butyl phenol), 4-methyl-2,6-di-tert-butylphenol, 2,2'-bis-(6-t-butyl-4-heptylphenol); 4,4'-bis(2,6-di-t-butyl phenol), 2,2'-methylenebis(4-methyl-6-t-butylphenol), and 2,2'-methylene bis(4-ethyl-6-t-butylphenol).

Phenols of the invention also include polyhydric aromatic compounds and their derivatives. Examples of suitable polyhydric aromatic compounds include esters and amides of gallic acid, 2,5-dihydroxybenzoic acid, 2,6-dihydroxybenzoic acid, 1,4-dihydroxy-2-naphthoic acid, 3,5-dihydroxynaphthoic acid, 3,7-dihydroxy naphthoic acid, and mixtures thereof.

In one embodiment, the phenolic antioxidant comprises a hindered phenol. In another embodiment the hindered phenol is derived from 2,6-ditertbutyl phenol.

In one embodiment the lubricating composition of the invention comprises a phenolic antioxidant in a range of 0.01 wt % to 5 wt %, or 0.1 wt % to 4 wt %, or 0.2 wt % to 3 wt %, or 0.5 wt % to 2 wt % of the lubricating composition.

Sulfurized olefins are well known commercial materials, and those which are substantially nitrogen-free, that is, not containing nitrogen functionality, are readily available. The olefinic compounds which may be sulfurized are diverse in nature. They contain at least one olefinic double bond, which is defined as a non-aromatic double bond; that is, one connecting two aliphatic carbon atoms. These materials generally have sulfide linkages having 1 to 10 sulfur atoms, for instance, 1 to 4, or 1 or 2. In one embodiment, the lubricating composition of the invention comprises a sulfurized olefin in a range 0.2 weight percent to 2.5 weight percent, or 0.5 weight percent to 2.0 weight percent, or 0.7 weight percent to 1.5 weight percent.

The ashless antioxidants of the invention may be used separately or in combination. In one embodiment of the invention, two or more different antioxidants are used in combination, such that there is at least 0.1 weight percent of each of the at least two antioxidants and wherein the combined amount of the ashless antioxidants is 0.5 to 5 weight percent. In one embodiment, there may be at least 0.25 to 3 weight percent of each ashless antioxidant. In one embodiment, there may be 1.0 to 5.0 weight percent of one or more ashless antioxidants, or 1.4 to 3.0 weight percent of one or more antioxidants.

In one embodiment, the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm, or 5 ppm to 300 ppm, or 20 ppm to 250 ppm of molybdenum.

In one embodiment, the invention provides a lubricating composition further comprising a friction modifier. Examples of friction modifiers include long chain fatty acid derivatives of amines, fatty esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides. The term fatty, as used herein, can mean having a C8-22 linear alkyl group.

Friction modifiers may also encompass materials such as sulfurized fatty compounds and olefins, molybdenum dialkyldithiophosphates, molybdenum dithiocarbamates, sunflower oil or monoester of a polyol and an aliphatic carboxylic acid.

In one embodiment, the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0.05 wt % to 6 wt %, or 0.05 wt % to 4 wt %, or 0.1 wt % to 2 wt % of the lubricating composition.

In one embodiment, the friction modifier may be a long chain fatty acid ester. In another embodiment the long chain fatty acid ester may be a mono-ester or a diester or a mixture thereof, and in another embodiment the long chain fatty acid ester may be a triglyceride.

Other performance additives such as corrosion inhibitors include those described in paragraphs 5 to 8 of US Application US05/038319, published as WO2006/047486, octyl octanamide, condensation products of dodecenyl succinic acid or anhydride and a fatty acid such as oleic acid with a polyamine. In one embodiment, the corrosion inhibitors include the Synalox® (a registered trademark of The Dow Chemical Company) corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

The lubricating composition may further include metal deactivators, including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors, including copolymers of ethyl acrylate and 2-ethylhexylacrylate and copolymers of ethyl acrylate and 2-ethylhexylacrylate and vinyl acetate; demulsifiers including trialkyl phosphates, polyethylene glycols, polyethylene oxides, polypropylene oxides and (ethylene oxide-propylene oxide) polymers; and pour point depressants, including esters of maleic anhydride-styrene, polymethacrylates, polyacrylates or polyacrylamides.

Pour point depressants that may be useful in the compositions of the invention further include polyalphaolefins, esters of maleic anhydride-styrene, poly(meth)acrylates, polyacrylates or polyacrylamides.

In different embodiments, the lubricating composition may have a composition as described in the following table:

| Additive | Embodiments (wt %) | | |
|---|---|---|---|
| | A | B | C |
| Borated Dispersant | 0.05 to 12 | 0.75 to 8 | 0.5 to 6 |
| Organo-phosphorus Antiwear Agent | 0 to 15 | 0.1 to 10 | 0.3 to 5 |
| Phosphorus-free Anti-Wear Agent | 0 to 0.5 | 0.01 to 0.2 | 0.03 to 0.1 |
| Overbased Sulfonate Detergent | 0 to 15 | 0.1 to 10 | 0.2 to 8 |
| Antioxidant | 0 to 15 | 0.1 to 10 | 0.5 to 5 |
| Dispersant Viscosity Modifier | 0 to 5 | 0 to 4 | 0.05 to 2 |
| Other Detergent | 0 to 15 | 0.1 to 10 | 0.2 to 8 |
| Other Dispersant | 0 to 10 | 0.1 to 5 | 1.0 to 4 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

The present invention provides a surprising ability to control damage to an engine in operation due to wear and deposit formation. This is accomplished while maintaining fuel economy performance, low sulfated ash levels, and other limitations, required by increasingly stringent government regulations.

Industrial Application

As described above, the invention provides for a method of lubricating an internal combustion engine comprising supplying to the internal combustion engine a lubricating composition as disclosed herein. Generally, the lubricant is added to the lubricating system of the internal combustion engine, which then delivers the lubricating composition to the critical parts of the engine, during its operation, that require lubrication The lubricating compositions described above may be utilized in an internal combustion engine. The engine components may have a surface of steel or aluminum (typically a surface of steel), and may also be coated for example with a diamond-like carbon (DLC) coating.

An aluminum surface may be comprised of an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may be fitted with an emission control system or a turbocharger. Examples of the emission control system include diesel particulate filters (DPF), or systems employing selective catalytic reduction (SCR).

The internal combustion engine of the present invention is distinct from a gas turbine. In an internal combustion engine, individual combustion events translate from a linear reciprocating force into a rotational torque through the rod and crankshaft. In contrast, in a gas turbine (which may also be referred to as a jet engine) a continuous combustion process generates a rotational torque continuously without translation, and can also develop thrust at the exhaust outlet. These differences in operation conditions of a gas turbine and internal combustion engine result in different operating environments and stresses.

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt % or less, or 0.5 wt % or less, or 0.3 wt % or less. In one embodiment, the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulfated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment, the sulfated ash content may be 0.05 wt % to 0.9 wt %, or 0.1 wt % to 0.2 wt % or to 0.45 wt %.

In one embodiment, the lubricating composition may be an engine oil, wherein the lubricating composition may be characterized as having at least one of (i) a sulfur content of 0.5 wt % or less, (ii) a phosphorus content of 0.1 wt % or less, (iii) a sulfated ash content of 1.5 wt % or less, or combinations thereof.

EXAMPLES

The invention will be further illustrated by the following examples, which set forth particularly advantageous embodiments. While the examples are provided to illustrate the invention, they are not intended to limit it.

Lubricating Compositions

A series of 5W-30 diesel engine lubricants in Group III and Group IV base oils of lubricating viscosity are prepared containing the additives described above as well as conventional additives including polymeric viscosity modifier, ashless succinimide dispersant, overbased detergents, antioxidants (combination of phenolic ester and diarylamine), zinc dialkyldithiophosphate (ZDDP), as well as other performance additives as follows (Table 1). The phosphorus, zinc and ash contents of each of the examples are also presented in the table in part to show that each example has a similar amount of these materials and so provide a proper comparison between the comparative and invention examples.

TABLE 1

Lubricating Oil Composition Formulations[1]

| | EX1 | EX2 | EX3 | EX4 | EX5 |
|---|---|---|---|---|---|
| Polyalphaolefin (PAO) | 20 | 20 | 20 | 20 | 20 |
| Group III Base Oil | Balance to 100% | | | | |
| Borated Dispersant A[2] | 0 | 2 | 2 | 2 | 0 |
| Borated Dispersant B[3] | 0 | 0 | 0 | 0 | 2.1 |
| Non-borated dispersant[4] | 6.3 | 2.8 | 3.8 | 2.6 | 2.8 |
| Overbased Ca sulfonate[5] | 0.06 | 0.61 | 0.61 | 0.61 | 0.61 |
| Calcium phenate[6] | 1.0 | 0 | 0 | 0 | 0 |
| Secondary ZDDP[7] | 0.8 | 0.4 | 0.4 | 0.4 | 0.4 |
| Organo-phosphorus AW[8] | 0 | 0.83 | 0.83 | 0.83 | 0.83 |
| Ashless AW agent[9] | 0.05 | 0.05 | 0.05 | 0.05 | 0.05 |
| Hindered phenol[10] | 3 | 3 | 3 | 3 | 3 |
| Diarylamine[11] | 0.5 | 0.85 | 0.5 | 0.5 | 0.5 |
| VI Improver[12] | 1.1 | 1.0 | 1.0 | 1.0 | 1.0 |
| Additional Additives[13] | 0.43 | 0.43 | 0.43 | 0.43 | 0.43 |
| % Phosphorus | 0.0748 | 0.0804 | 0.0815 | 0.0833 | 0.0806 |
| % Zinc | 0.0821 | 0.0409 | 0.0414 | 0.0402 | 0.0402 |
| % Calcium | 0.1598 | 0.1601 | 0.1601 | 0.1646 | 0.1642 |
| % B | 0 | 0.0152 | 0.0160 | 0.0158 | 0.0168 |
| TBN (ASTM D2896) | 6.6 | 6.5 | 6.4 | 6.5 | 6.7 |

TABLE 1-continued

Lubricating Oil Composition Formulations[1]

| | EX1 | EX2 | EX3 | EX4 | EX5 |
|---|---|---|---|---|---|
| % Phenate soap | 0.51 | 0 | 0 | 0 | 0 |
| % Sulfonate soap | 0.65 | 0.21 | 0.21 | 0.21 | 0.21 |
| % Total soap | 1.16 | 0.21 | 0.21 | 0.21 | 0.21 |
| % Ash | 0.7 | 0.7 | 0.7 | 0.7 | 0.7 |

[1]All amounts shown above are in weight percent and are on an oil-free basis unless otherwise noted.
[2]Polyisobutylene succinimide dispersant derived from 2000 Mn PIB having ~80% terminal vinylidene; 0.8 weight % Boron; TBN 26 mg KOH/g; N:CO ratio 1:0.9
[3]Polyisobutylene succinimide dispersant derived from 2000 Mn PIB having ~80% terminal vinylidene; 0.8 weight % Boron; TBN 26 mg KOH/g; N:CO ratio 1:1.3
[4]PIBsuccinimide dispersant
[5]Ca Detergent is one or more overbased calcium alkylbenzene sulfonic acid with TBN at least 300 and metal ratio at least 10
[6]Ca Phenate is 255 TBN sulfur-coupled calcium phenate
[7]Mixture of C3 and C6 secondary alkyl groups
[8]C16-18 dialkyl hydrogen phosphonate
[9]Oleyl amide
[10]Hindered phenol - Butyl 3-(3,5-ditert-butyl-4-hydroxyphenyl)propanoate
[11]Diaryl amine - mixture of nonylated and dinonylated diphenylamine
[12]Styrene-butadiene block copolymer
[13]The Additional Additives used in the examples include sulfurized olefin, pourpoint depressants, anti-foam agents, corrosion inhibitors, and includes some amount of diluent oil

Evaluation of Lubricant Formulations

Engine Cleanliness Test: The lubricant formulations of Table 1 were subjected to a series of performance evaluations including engine test VW TDI CEC-L-78-T-99 test, also known as the PV1452 test. This test is regarded as an industry standard and is a severe assessment of a lubricant's performance capabilities. The test employs a 4-cylinder, 1.9 liter, 81 kW passenger car diesel engine, which is a direct injection engine in which a turbocharger system is used to increase the power output of the unit. The industry test procedure consists of a repeating cycle of hot and cold running conditions. This involves a 30 minute idle period at zero load followed by 180 minutes at full load and 4150 rpm. In the standard test, the entire cycle is then repeated for a total of 54 hours. In this 54 hour period, the initial oil fill of 4.5 liters of test lubricant is not topped up. At the end of the 54 hour test, the engine is drained, the engine disassembled and the pistons rated for piston deposits and piston ring sticking. This affords a result which is assessed relative to an industry reference oil (RL206) to define passing or failing performance.

The pistons are rated against what is known as the DIN rating system. The three piston-ring grooves and the two piston lands that lie between the grooves are rated on a merit scale for deposits and given a score out of 100 by a method known to those skilled in the art. In summary, the higher the number the better the performance: 100 indicates totally clean and 0 indicates totally covered with deposit. The five scores are then averaged to give the overall piston cleanliness merit rating. The scores for each of the four pistons are then averaged to afford the overall piston cleanliness for the test.

Nitration/Oxidation test: The lubricant formulations were evaluated in a nitration/oxidation bench test which assesses the oxidation and nitration resistance of crankcase engine oil formulations. The formulation is treated with nitric acid and iron naphthanoate prior to administering 50 cc/min of NOx gas whilst heating to 145° C. for 22 hours. An IR spectroscopic method is used to determine degree of sample nitration and oxidation. Additionally, TBN (ASTM D2896 and D4739) and TAN (ASTM D664) are measured. SOT and EOT to determine TBN retention and TAN escalation profiles Friction and Wear test: The lubricant formulations were evaluated under TE-77 friction and wear testing. Tests were run at each of a higher temperature and load (147° C. and 616N) and at a lower temperature and load (100° C. and 100N).

| TE-77 - High T, high load | |
|---|---|
| Temp. Ramp (° C.) | To 147 in 15 mins and hold for 2 hours |
| Ramp Load (N) | Ramp to 616 in 5 mins and hold for 2 hours 10 mins |
| Stroke Length (mm) | 10 |
| Frequency (Hz) | 10 |
| Upper Test Piece | Nitrided Steel Standard Phoenix 6 mm dia. Cylinder |
| Lower Test Piece | 8620 Steel |
| TE-77 - Low T, low load | |
| Temp. Ramp (° C.) | To 100 in 15 mins and hold for 1 hours |
| Ramp Load (N) | Ramp to 100 in 5 mins and hold for 70 minutes |
| Stroke Length (mm) | 10 |
| Frequency (Hz) | 10 |
| Amplifier (N/V) | 5 |
| Upper Test Piece | Nitrided Steel Standard Phoenix 6 mm dia. Cylinder |
| Lower Test Piece | 8620 Steel |

PV3344 VW seals test: This is an industry standard test designed to quantify the adverse effect of a lubricating oil has on fluorelastomeric seal materials. These materials are commonly used as engine seals. These must be passed in order to receive a VW engine oil approval. The particular seals tests below use the AK6 elastomer which is known to be challenging due to oil changes employed and the particular sensitivity to commonly used engine oil components.

Data from the Lubricant Formulation evaluations is provided in Table 2.

TABLE 2

Data for 5W-30 Lubricants for Diesel Engines

| | EX1 | EX2 | EX3 | EX4 | EX5 |
|---|---|---|---|---|---|
| VW TDI | | | | | |
| Average Piston Cleanliness Rating | 65 | 67 | 66 | 67 | 65 |
| Nitration bench test | | | | | |
| End of test TBN (mg KOH/g) | 3.3 | 3.9 | 4.3 | 4 | 4.5 |
| TE77 High T, High Load | | | | | |
| Coefficient of friction | 0.132 | 0.121 | 0.125 | 0.123 | 0.120 |
| Wear Scar (mm) | 318 | 259 | 291 | 275 | 247 |
| TE77 Low T, Low Load | | | | | |
| Coefficient of friction | 0.135 | 0.122 | 0.125 | 0.125 | 0.122 |
| Wear Scar (mm) | 128 | 138 | 66 | 67 | 97 |
| PV3344 FPM SEALS | | | | | |
| Final tensile strength | 7.5 | 13.6 | 14.3 | 12.3 | 11.5 |
| Final rupture elongation | 158 | 302 | 266 | 229 | 211 |

The data indicates that using this formulating style, improvements in TBN retention, friction, wear and seals can be made while maintaining deposit performance shown by the TDI results. Wear performance has been improved despite reductions in ZDDP level, deposit performance has been maintained despite significant reductions in overall detergent soap levels and phenate soap in particular.

A series of 0W-20 diesel engine lubricants in Group III and Group IV base oils of lubricating viscosity are prepared containing the additives described above as well as conventional additives including polymeric viscosity modifier, ashless succinimide dispersant, overbased detergents, antioxidants (combination of phenolic ester and diarylamine), zinc dialkyldithiophosphate (ZDDP), as well as other performance additives as follows (Table 3). The phosphorus, zinc and ash contents of each of the examples are also presented in the table in part to show that each example has a similar amount of these materials and so provide a proper comparison between the comparative and invention examples.

TABLE 3

0W-20 Lubricating Oil Composition Formulations[1]

| | EX6 | EX7 | EX8 | EX9 | EX10 |
|---|---|---|---|---|---|
| Polyalphaolefin (PAO) | 77.7 | 77.8 | 67.7 | 10 | 10 |
| Group III Base Oil | Balance to 100% | | | | |
| Borated Dispersant[2] | 0 | 0 | 0 | 1.4 | 1.4 |
| Non-borated dispersant[4] | 5.5 | 5.5 | 5.5 | 2.1 | 2.1 |
| Oxyalkylated Hydrocarbyl Phenol | 0 | 0 | 0 | 1.5 | 1.5 |
| Dispersant viscosity modifier | 0 | 0 | 0 | 0.26 | 0.26 |
| Overbased Ca sulfonate[5] | 0.23 | 0.23 | 0.23 | 0.46 | 0.46 |
| Overbased Mg sulfonate | 0 | 0 | 0 | 0.41 | 0.41 |
| Calcium salixarate | 0 | 0 | 0 | 0.20 | 0.20 |
| Calcium phenate[6] | 0.25 | 0.25 | 0.25 | 0 | 0 |
| Secondary ZDDP[7] | 0.8 | 0.8 | 0.8 | 0.4 | 0.4 |
| Organo-phosphorus AW[8] | 0 | 0 | 0 | 0.6 | 0.6 |
| Ashless AW agent[9] | 0.05 | 0.05 | 0.05 | 0.05 | 0.05 |
| Hindered phenol[10] | 3 | 3 | 3 | 2 | 2 |
| Diary lamine[11] | 0.6 | 0.6 | 0.6 | 0.5 | 0.5 |
| VI Improver[12] | 0.6 | 0.6 | 0.6 | 0.4 | 0.62 |
| Additional Additives[13] | 0.63 | 0.63 | 0.63 | 0.42 | 0.42 |
| % Phosphorus | 0.0761 | 0.0747 | 0.0730 | 0.0732 | 0.709 |
| % Zinc | 0.0832 | 0.082 | 0.0822 | 0.0437 | 0.0442 |
| % Calcium | 0.1651 | 0.1625 | 0.1834 | 0.1132 | 0.1124 |
| % Magnesium | 0 | 0 | 0 | 0.0708 | 0.0661 |
| % Boron | 0 | 0 | 0 | 0.0095 | 0.0090 |
| TBN (ASTM D2896) | 6.5 | 6.6 | 6.6 | 6.8 | 7.1 |
| % Ash | 0.7 | 0.7 | 0.7 | 0.7 | 0.8 |
| % Phenate soap | 0.37 | 0.26 | 0.19 | 0 | 0 |
| % Salixarate soap | 0 | 0 | 0 | 0.17 | 0.17 |
| % Sulfonate soap | 0.11 | 0.14 | 0.18 | 0.40 | 0.40 |
| % Total soap | 0.48 | 0.4 | 0.37 | 0.57 | 0.57 |

[1]All amounts shown above are in weight percent and are on an oil-free basis unless otherwise noted.

[2]Polyisobutylene succinimide dispersant derived from 2000 Mn PIB having ~80% terminal vinylidene; 0.8 weight % Boron; TBN26 mg KOH/g; N:CO ratio 1:1.3

[4]PIBsuccinimide dispersant

[5]Ca Detergent is one or more overbased calcium alkylbenzene sulfonic acid with TBN at least 300 and metal ratio at least 10

[6]Ca Phenate is 255 TBN sulfur-coupled calcium phenate

[7]Mixture of C3 and C6 secondary alkyl groups

[8]C16-18 dialkyl hydrogen phosphonate

[9]Oleyl amide

[10]Hindered phenol - Butyl 3-(3,5-ditert-butyl-4-hydroxyphenyl)propanoate

[11]Diaryl amine - mixture of nonylated and dinonylated diphenylamine

[12]Styrene-butadiene block copolymer

[13]The Additional Additives used in the examples include sulfurized olefin, pourpoint depressants, anti-foam agents, corrosion inhibitors, and includes some amount of diluent oil

Evaluation of Lubricant Formulations

Engine Cleanliness Test: The lubricant formulations of Table 3 were subjected to a series of performance evaluations including engine test VW TDI (as above). in addition to average piston deposit rating, end of test TBN is measured as part of the test procedure (Table 4 below).

TABLE 4

Engine Cleanliness Data for 0W-20 Engine Oil Lubricants

| VW TDI | EX6 | EX7 | EX8 | EX9 | EX10 |
|---|---|---|---|---|---|
| Piston cleanliness | 69 | 65 | 65 | 66 | 62 |
| End of test TBN (mg KOH/g) | 4.3 | 3.8 | 3.4 | 5.8 | 6.2 |

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference, as is the priority document and all related applications, if any, which this application claims the benefit of Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy); (iii) hetero substituents, that is, substituents which, while having a predominantly hydrocarbon character, in the context of this invention, contain other than carbon in a ring or chain otherwise composed of carbon atoms.

Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims

What is claimed is:

1. A low zinc lubricating composition comprising:

an oil of lubricating viscosity;

1.0 wt. % to 3 wt. % of a borated polyisobutylene succinimide dispersant derived from a polyisobutylene having number average molecular weight of 350 to 5000 Daltons and a vinylidene content of at least 50 mol % in an amount to deliver at least 100 ppm of boron to the lubricating composition;

1.5 wt. % to 4 wt. % of a non-borated polyisobutylene succinimide dispersant;

a secondary zinc dialkyldithiophosphate having a mixture of C3 and C6 secondary alkyl groups in an amount to provide from 0.03 wt % to 0.05 wt % of zinc to the lubricating composition; and 0.5 wt. % to 1 wt. % of a C16-C18 dialkyl hydrogen phosphonate anti-wear additive, wherein the lubricating composition is substantially free of a metal-containing sulfur-coupled alkylphenol, and an oxyalkylated hydrocarbyl phenol represented by formula:

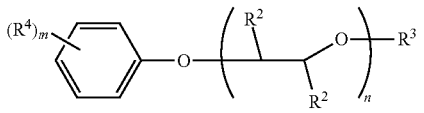

wherein each $R^2$ is independently hydrogen or a hydrocarbyl group of 1 to 6 carbon atoms;

$R^3$ is hydrogen, a hydrocarbyl group of 1 to 24 carbon atoms, or an acyl group represented by —C(=O)$R^5$, $R^5$ is a hydrocarbyl group of 1 to 24 carbon atoms;

each $R^4$ is independently a hydrocarbyl group of 1 to 220 carbon atoms, wherein at least one $R^4$ contains 25 to 200 carbon atoms;

n=1 to 10; and m=1 to 3;

wherein the lubricating composition contains zinc in an amount less than 600 ppm by weight of the composition.

2. The lubricating composition of claim 1, wherein the dialkyl hydrogen phosphonate anti-wear additive is free of sulfur.

3. The lubricating composition of claim 1, further comprising a metal containing sulfonate detergent.

4. The lubricating composition of claim 3, wherein the metal of the sulfonate detergent is selected from magnesium, calcium, sodium and mixtures thereof.

5. The lubricating composition of claim 4, wherein the metal containing sulfonate detergent comprises a magnesium containing sulfonate detergent.

6. The lubricating composition of claim 3, wherein the metal containing sulfonate detergent is present at 0.1 to 10 wt. % of the composition.

7. The lubricating composition of claim 3, wherein the metal containing sulfonate detergent is overbased.

8. The lubricating composition of claim 3, wherein the metal containing sulfonate detergent includes a magnesium sulfonate detergent present to provide at least 200 ppm of magnesium to the lubricating composition and a calcium sulfonate detergent present to provide at least 1000 ppm of calcium to the lubricating composition.

9. The lubricating composition of claim 1, wherein the lubricating composition is substantially free or free of a metal containing methylene coupled alkyphenol compound.

10. A method of lubricating a light duty compression-ignition internal combustion engine, comprising supplying to said engine a lubricant composition a lubricating composition of claim 1.

* * * * *